US007059004B2

(12) United States Patent
Mitchell et al.

(10) Patent No.: US 7,059,004 B2
(45) Date of Patent: Jun. 13, 2006

(54) FLOOR SURFACE TREATMENT APPARATUS

(75) Inventors: Kevin Mitchell, West Fork, AR (US); John L. Obenshain, Rogers, AR (US)

(73) Assignee: Alto U.S. Inc., Springdale, AR (US)

( * ) Notice: Subject to any disclaimer, the term of this patent is extended or adjusted under 35 U.S.C. 154(b) by 407 days.

(21) Appl. No.: 10/216,582

(22) Filed: Aug. 9, 2002

(65) Prior Publication Data

US 2004/0025270 A1 Feb. 12, 2004

(51) Int. Cl.
*A47L 11/293* (2006.01)

(52) U.S. Cl. ..... 15/50.1; 15/320; 15/340.2; 15/340.4; 15/49.1; 15/79.2

(58) Field of Classification Search ..... 15/50.1, 15/320, 340.2, 340.4, 49.1, 79.2, 87, 98
See application file for complete search history.

(56) References Cited

U.S. PATENT DOCUMENTS 5,048,141 A * 9/1991 Huppi ..... 15/49.1
5,369,236 A * 11/1994 Nickels, Jr. ..... 200/329
5,477,578 A 12/1995 Duncan et al.
6,763,544 B1 * 7/2004 Stuchlik ..... 15/50.1

* cited by examiner

*Primary Examiner*—Richard Crispino
*Assistant Examiner*—Abraham Bahta
(74) *Attorney, Agent, or Firm*—Blackwell Sanders Peper Martin LLP

(57) ABSTRACT

A floor surface treatment apparatus having a wheeled vehicle including a support for a floor surface treatment unit, the support being moveable relative to the vehicle. A floor surface treatment unit is pivotally carried by the support for swinging movement relative thereto. The support is configured to raise and lower the unit relative to the floor surface, upon movement of the support relative to the vehicle, through a range of working positions in which the unit maintains a generally vertical orientation relative to the floor surface and is generally in contact therewith and a servicing position in which the unit is swung up relative to the vehicle above the floor surface to a position in which the unit is generally angled relative to the floor surface.

25 Claims, 21 Drawing Sheets

FLOOR SURFACE TREATMENT APPARATUS

BACKGROUND OF THE INVENTION

The invention relates generally to floor surface treatment apparatus, more particularly to such apparatus embodied, for example, in a floor scrubber having a rotary brush or brushes for scrubbing the floor or a rotary pad for waxing and/or polishing the floor.

The invention is in a category similar to that of the coassigned U.S. patent Ser. No. 09/934,146 of William R. Stuchlik filed Aug. 21, 2001, published May 2, 2002 as Publication No. U.S. 2002-0050014-A1, which is incorporated herein by reference. The invention has been developed because of the need becoming recognized for apparatus in which the floor surface treatment unit (e.g. brush, brushes, pad) may be differently positioned, as for variation of its pressure on the floor during operation, for transport of the apparatus, and for facilitating servicing of the floor surface treatment unit.

BRIEF SUMMARY OF THE INVENTION

In general, a floor surface treatment apparatus of the present invention comprises a wheeled vehicle for travel over a floor surface. The vehicle has a support for a floor surface treatment unit wherein the support is moveable relative to the vehicle. A floor surface treatment unit is pivotally carried by the support for swinging movement relative thereto. The support is configured to raise and lower the unit relative to the floor surface, upon movement of the support relative to the vehicle, through a range of working positions in which the unit maintains a generally vertical orientation relative to the floor surface and is generally in contact therewith and a servicing position in which the unit is swung up relative to the vehicle above the floor surface to a position in which the unit is generally angled relative to the floor surface.

In another embodiment, the floor surface treatment apparatus generally comprises a wheeled vehicle for travel over a floor surface. The vehicle has a support for a floor surface treatment unit wherein the support is moveable relative to the vehicle. A floor surface treatment unit is carried by the support for movement with the support relative to the vehicle. An actuator is coupled to the support for driving movement of the support to move the floor surface treatment unit relative to the vehicle. The actuator is slidably mounted on the vehicle for sliding movement relative thereto.

BRIEF DESCRIPTION OF THE DRAWINGS

Corresponding reference characters indicate corresponding parts throughout the several views of the drawings.

DETAILED DESCRIPTION

Figure 1:
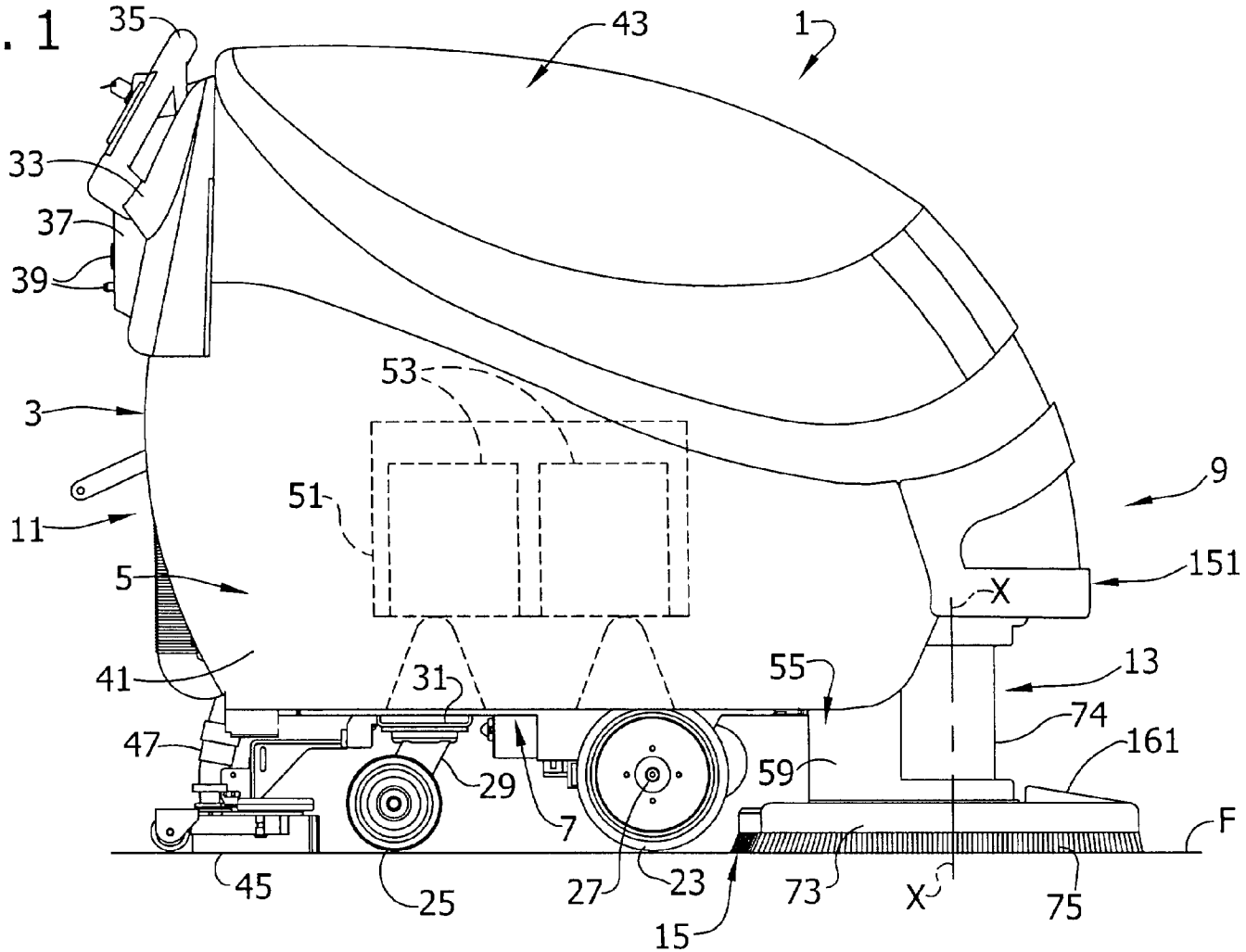
FIG. 1 is a view in elevation of the right side of a floor scrubber embodying the present invention showing a floor surface treatment unit thereof in a position contacting the floor (here and hereinafter "right" refers to the side on the right of the operator of the scrubber looking forward, e.g. to the right in FIG. 1)
Figure 2:
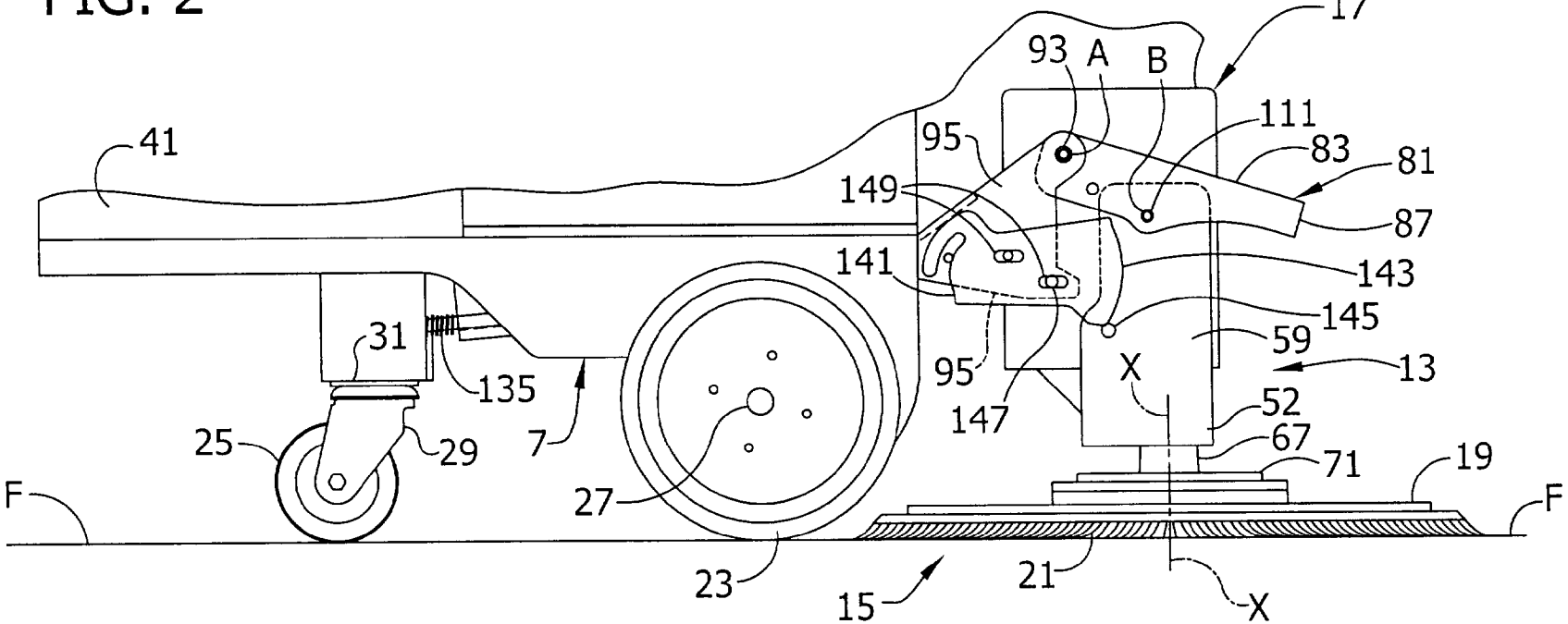
FIG. 2 is an enlarged fragment of FIG. 1 showing the unit in a full-down (maximum down-pressure) working position on the floor.
Figure 3:
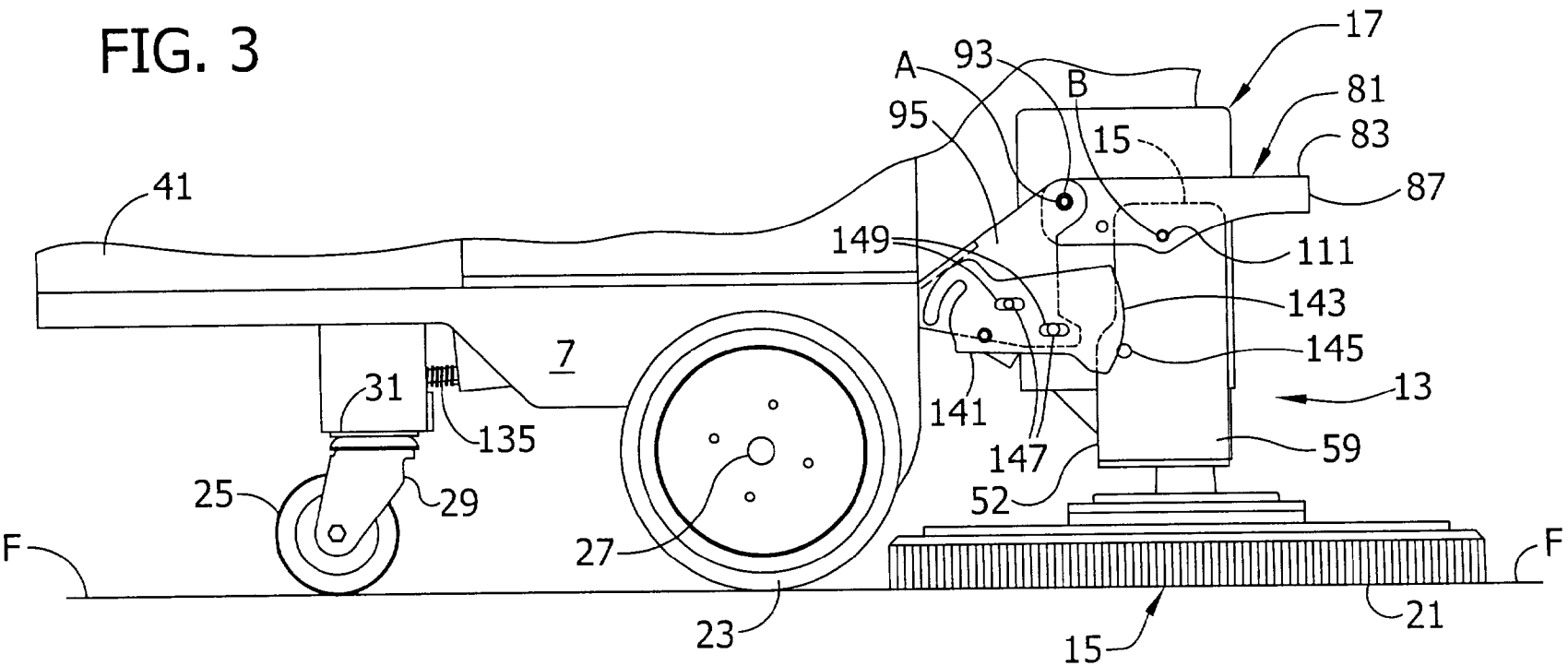
FIG. 3 is a view similar to FIG. 2 showing the unit in a minimum-pressure working position above the FIG. 2 position wherein tips of the brush bristles of the unit are contiguous to the floor.
Figure 4:
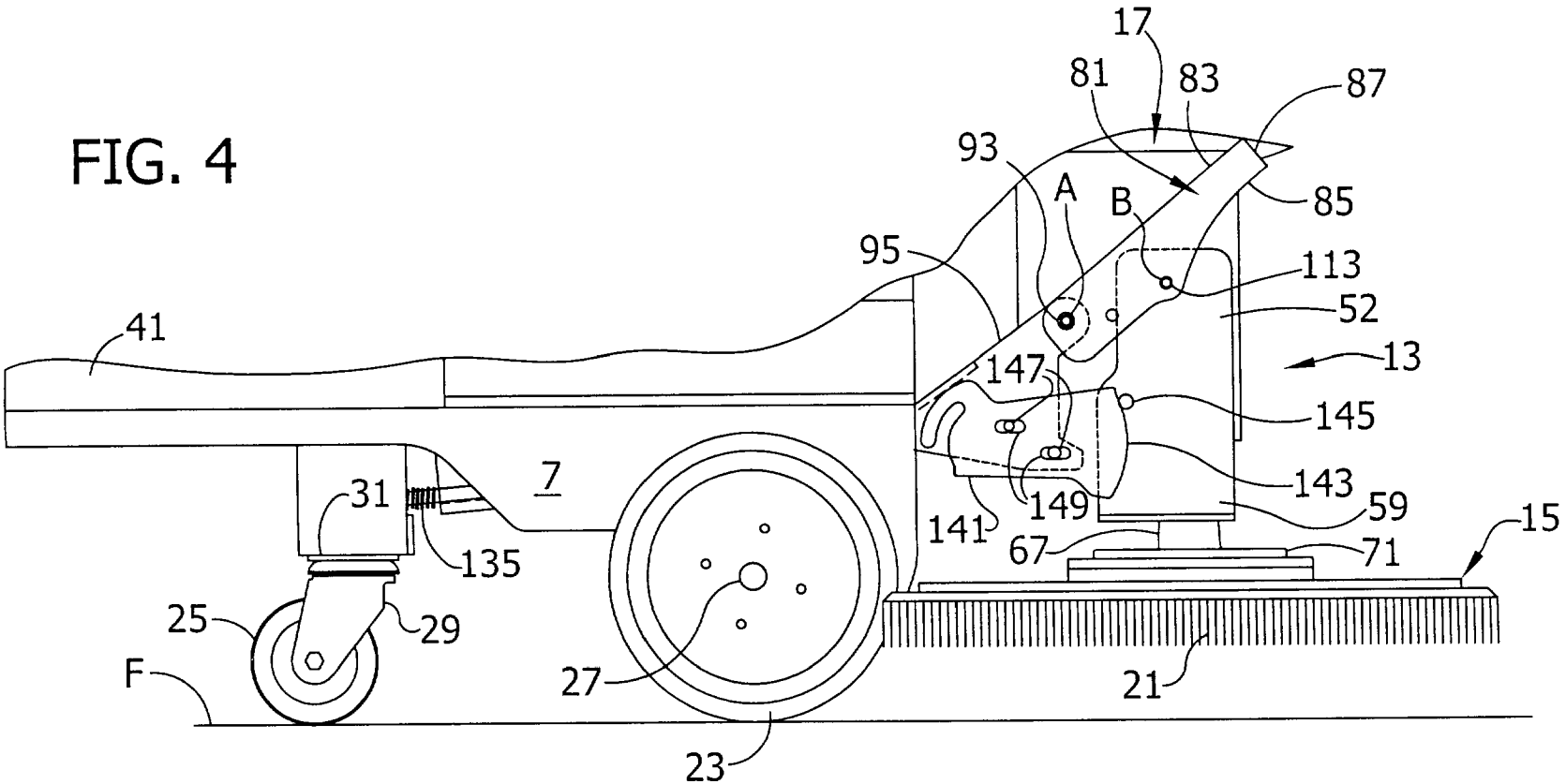
FIG. 4 is a view similar to FIGS. 2 and 3 showing the floor surface treatment unit raised to a transport position.

Now referring to the drawings, and in particular to FIG. 1, floor surface treatment apparatus of this invention is illustrated as embodied in a floor scrubber, designated 1 in its entirety. The floor scrubber 1 comprises a wheeled vehicle 3 having a body generally designated 5 on a chassis 7, the forward (or head) end of the vehicle being generally designated 9, the rearward (or operator's) end being generally designated 11. At the head end 9, the scrubber 1 has a floor surface treatment unit, designated 13 in its entirety and illustrated in FIGS. 1–9 as comprising a circular scrub brush designated generally at 15. The brush is rotary on an axis X by an electric motor 17 (FIG. 2) of the floor surface treatment unit 13. As shown further in FIG. 2, the brush 15 comprises a circular plate 19 having bristles 21 depending therefrom.

The wheeled vehicle 3, comprising the chassis 7 which carries the body 5, is adapted to be wheeled over a floor surface F for traversing the brush 15 over the floor surface. More particularly, the chassis 7 is supported by a pair of driven wheels 23 disposed beneath the chassis generally on opposite sides thereof just rearward of the brush 15, and a caster 25 disposed beneath the chassis rearward of the driven wheels 23. The wheels 23 are power-driven, each being on an axle 27 driven by a drive motor (not shown) beneath the chassis 7 for powered propulsion of the scrubber 1. A swivel 29 of the caster 25 swivels in a bearing 31 secured to the bottom of the chassis 7.

Still referring to FIG. 1, the body 5 of the scrubber 1 has a handle column 33 extending outward therefrom at its upper rear, and a handle 35 secured on the handle column (e.g., like a steering wheel) for being gripped by the operator of the scrubber for guiding or otherwise maneuvering it. An adjacent control panel 37 has various controls thereon such as indicated at 39 for controlling various operating components of the scrubber 1. The body 5 comprises a lower structure 41 supported by the chassis 7 and surmounted by an upper structure 43. The lower structure 41 comprises a tank for a floor cleaning solution to be delivered onto and scrubbed over the floor F by the brush 15 when the latter is in operation. The upper structure 43 comprises a cleaning solution recovery tank for recovering dirty solution left on the floor F by the brush 15. The scrubber 1 also has a squeegee 45 (e.g. an arcuate rubber squeegee) on the bottom of the chassis 7 at the rear thereof for sweeping up solution left on the floor F, and a vacuum system including a vacuum hose 47 and vacuum motor (not shown) for sucking up dirty solution swept by the squeegee. The lower structure 41 also has a top compartment indicated at 51 for housing batteries 53 which power the brush motor 17, the drive wheel motor, the vacuum motor and other electrical components of the scrubber 1.

As thus far described, the scrubber 1 is generally similar to that described in co-assigned U.S. patent application Ser. No. 09/934,146 of William R. Stuchlik, filed Aug. 21, 2001, published May 2, 2002 as Publication No. 2002-0050014-A1, and involves an arrangement of a type generally known in the art. Reference may be had to said published application, which is incorporated herein by reference, for certain detail. Construction and operation of the scrubber 1 will therefore not be further described herein except to the extent necessary to set forth the present invention.

The present invention resides primarily in the mounting of the floor surface treatment unit 13, including the scrub brush 15, on the scrubber 1 for selective movement to different positions comprising (a) a working position wherein the brush 15 engages the floor F in a generally vertical orientation for scrubbing (see FIGS. 1–3, 6 and 7); (b) a transport position wherein the brush is raised up off of the floor in its generally vertical orientation for transporting the scrubber (see FIGS. 4 and 8); and (c) a servicing position wherein the brush is swung up at an angle relative to the floor surface F for servicing of the unit 13 (see FIGS. 5 and 9). The "generally vertical orientation" of the floor surface treatment unit 13 is illustrated herein with the brush 5 horizontal to the floor surface F. However, it is understood that the brush 5, or the entire floor surface treatment unit 13, may be slightly tilted relative to the floor surface F, such as up to about ±10 degrees, in the "generally vertical orientation of the unit without departing from the scope of this invention, as long the orientation of the unit remains generally fixed during operation of the scrubber 1 in the working position of the unit.

With reference to FIGS. 2–9, the floor surface treatment unit 13 further comprises a cradle, designated generally at 52 for supporting the brush motor 17. The cradle 52 has right (FIGS. 2–5) and left (FIGS. 6–9) side walls designated respectively at 59 and 61, and a bottom wall (not shown) extending transversely between the side walls at the lower ends thereof. The brush motor 17 is seated in the cradle 52 on the bottom wall thereof with a longitudinal axis of the motor extending generally parallel to the side walls 59, 61. The motor 17 projects out to the rear from within the cradle 52 and up above the top of the cradle, the motor being suitably secured on the bottom wall of the cradle so that the motor and the cradle are fastened together for conjoint movement with each other. An output shaft 67 of the brush motor 17 extends down through an opening (not shown) in the bottom wall of the cradle 52 generally on the rotation axis X of the brush 15. On the lower end of the shaft 67 is a hub 71 for removable and replaceable attachment of the brush head plate 19.

Figure 21:
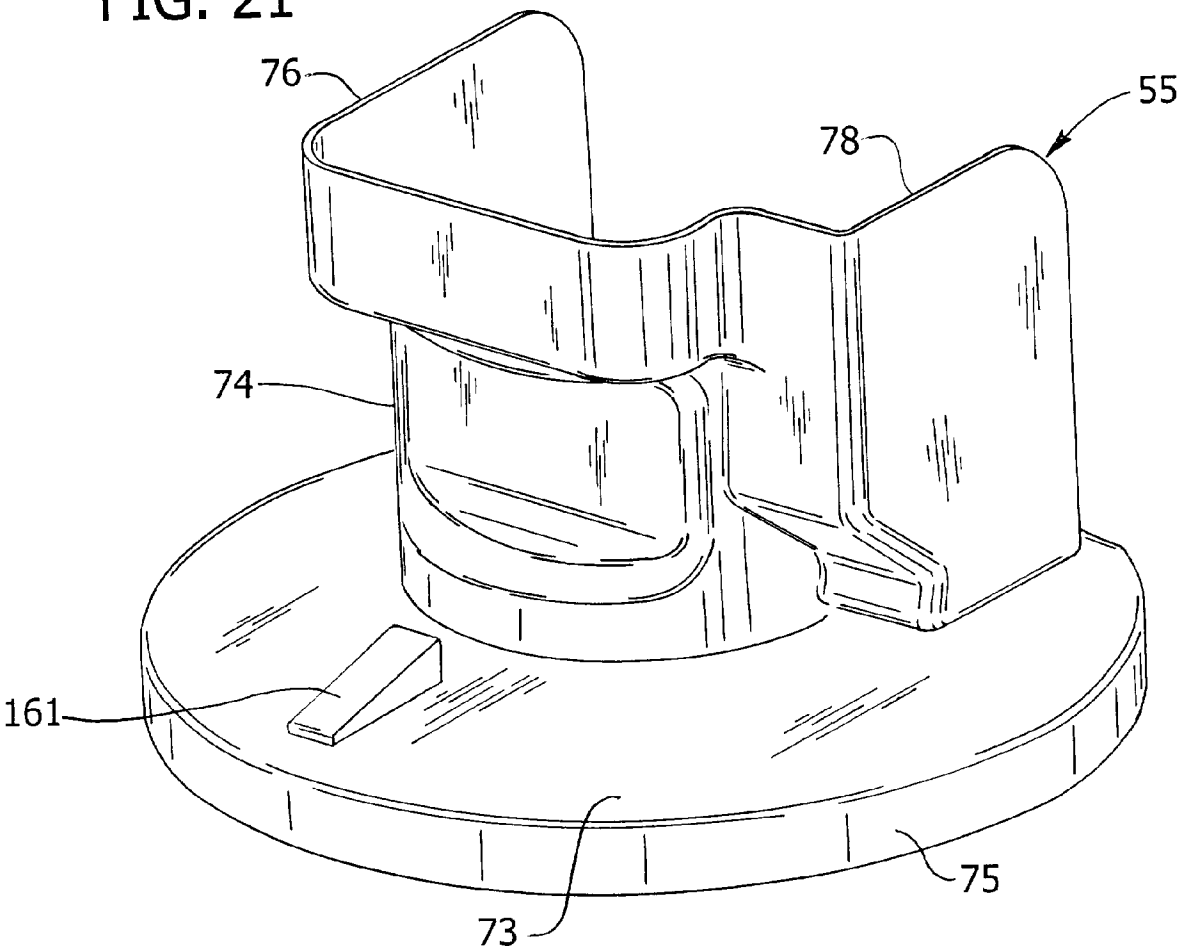
FIG. 21 is a perspective of a housing for the floor surface treatment unit of the scrubber.
Figure 22:
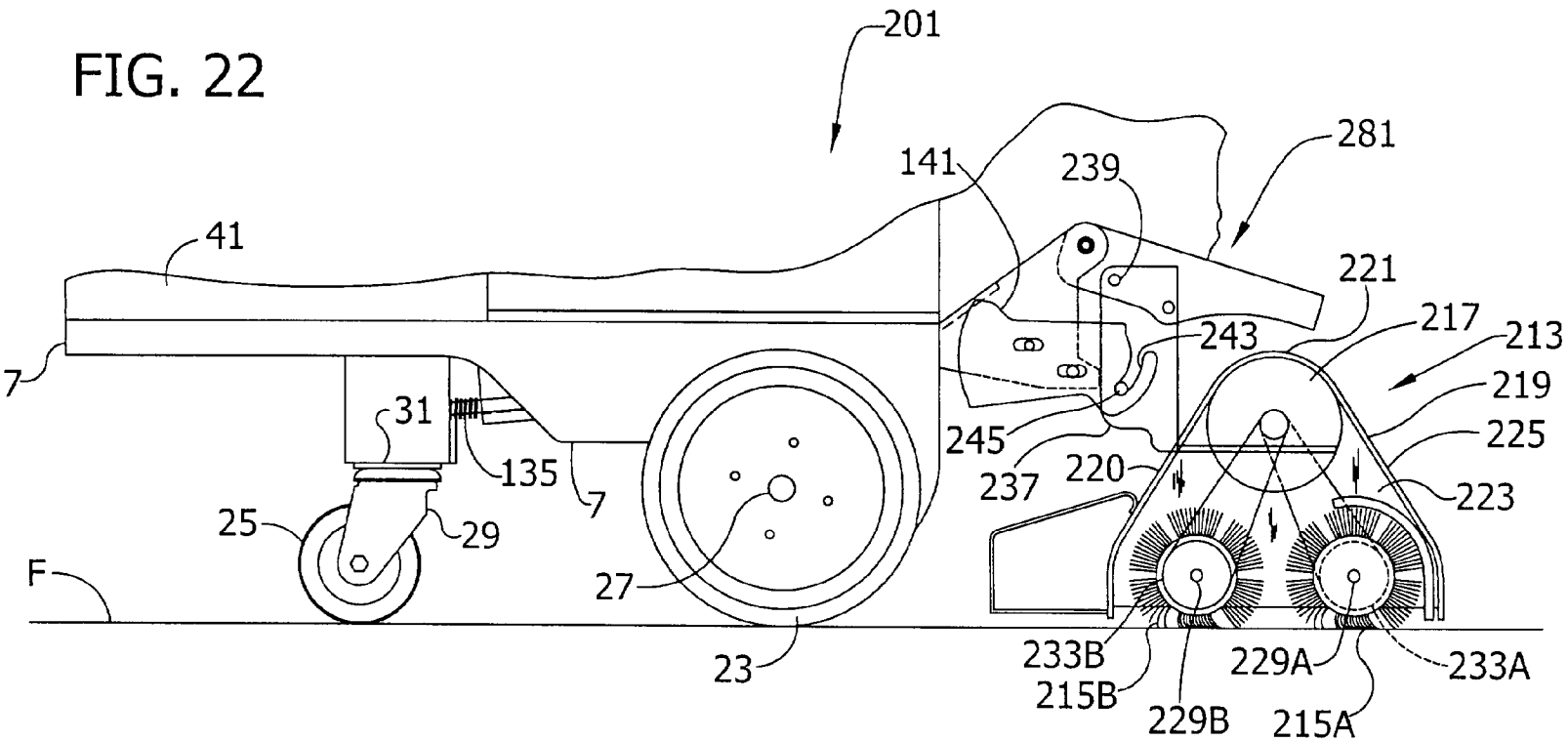
FIG. 22 is a fragmentary right side elevation showing a modification of the floor surface treatment unit of the scrubber; the unit being shown in a full-down (maximum pressure) working position.
Figure 23:
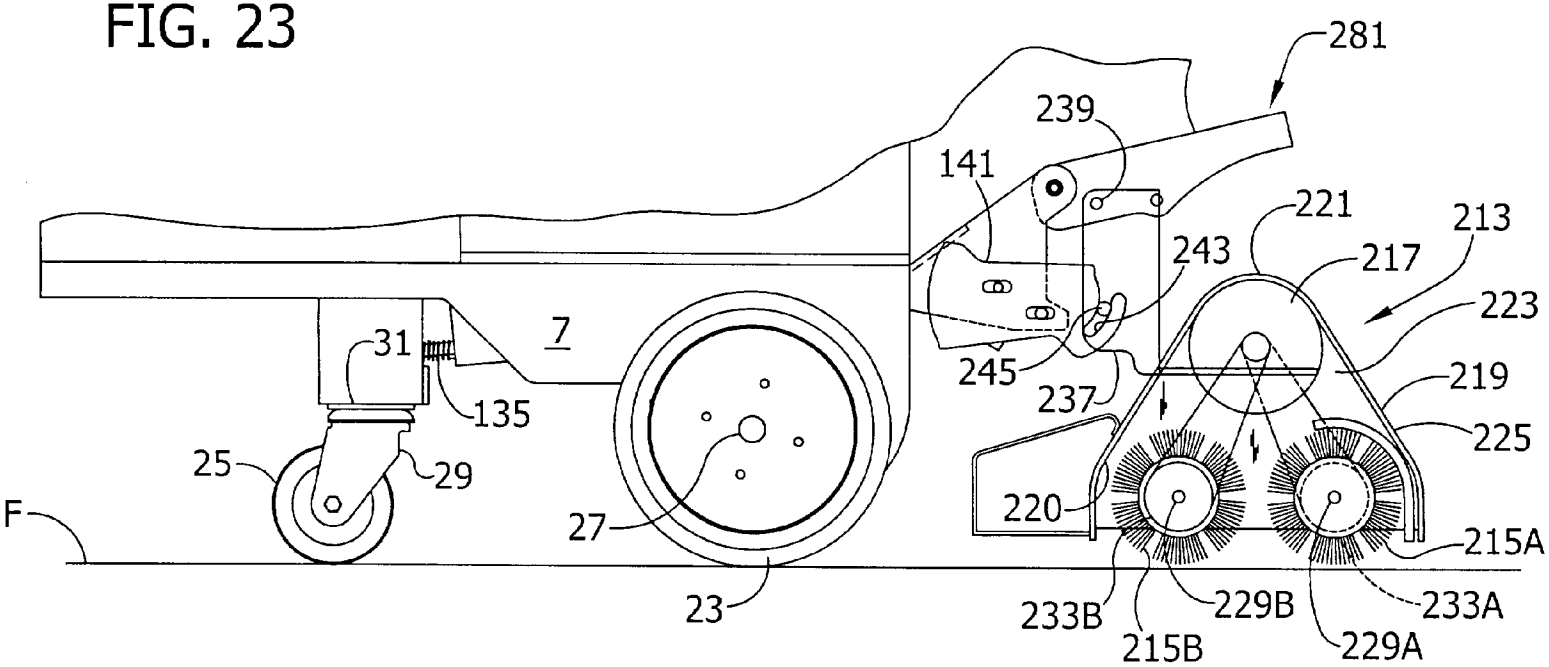
FIG. 23 is a view similar to FIG. 22 showing the unit in its minimum-pressure working position.
Figure 24:
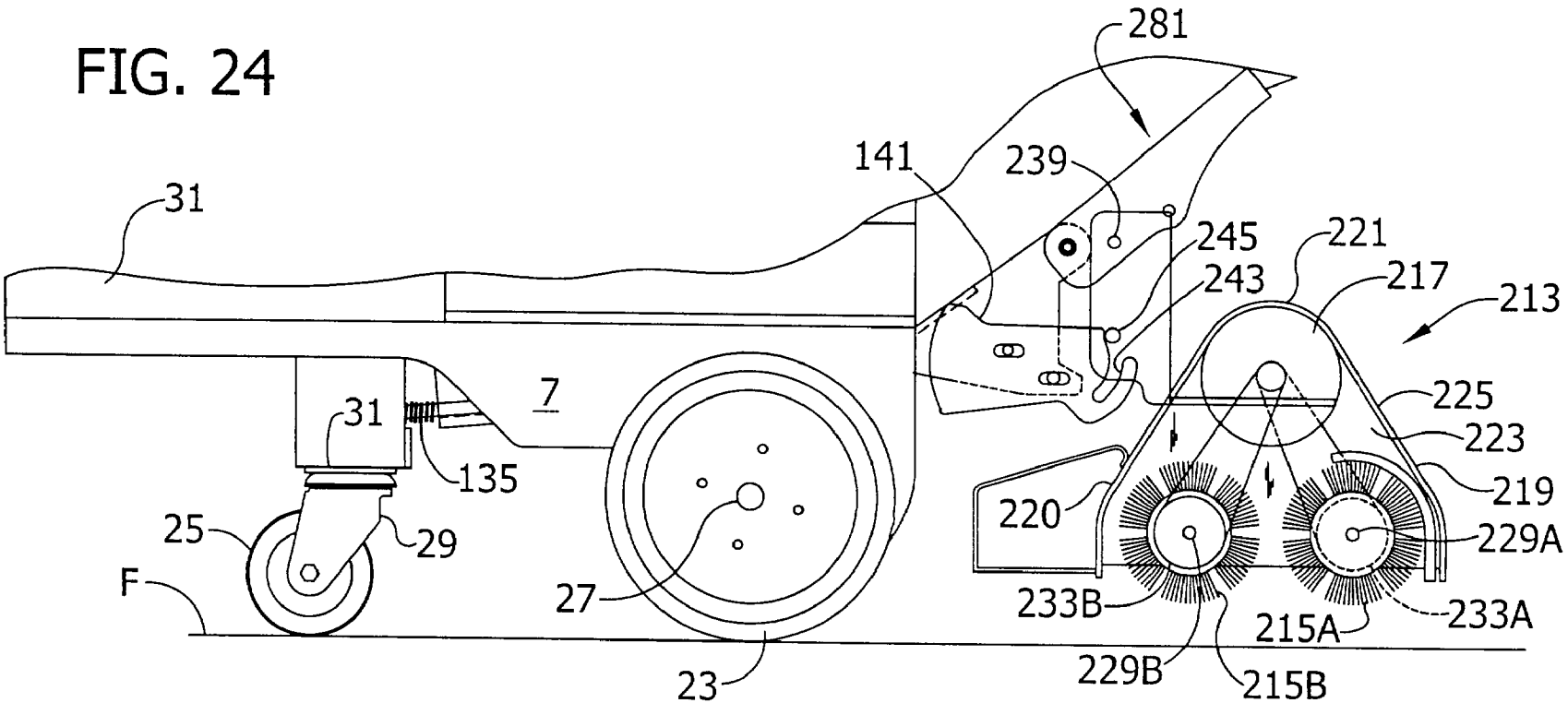
FIG. 24 is a view similar to FIGS. 22 and 23 showing the unit up off the floor in a transport position.
Figure 25:
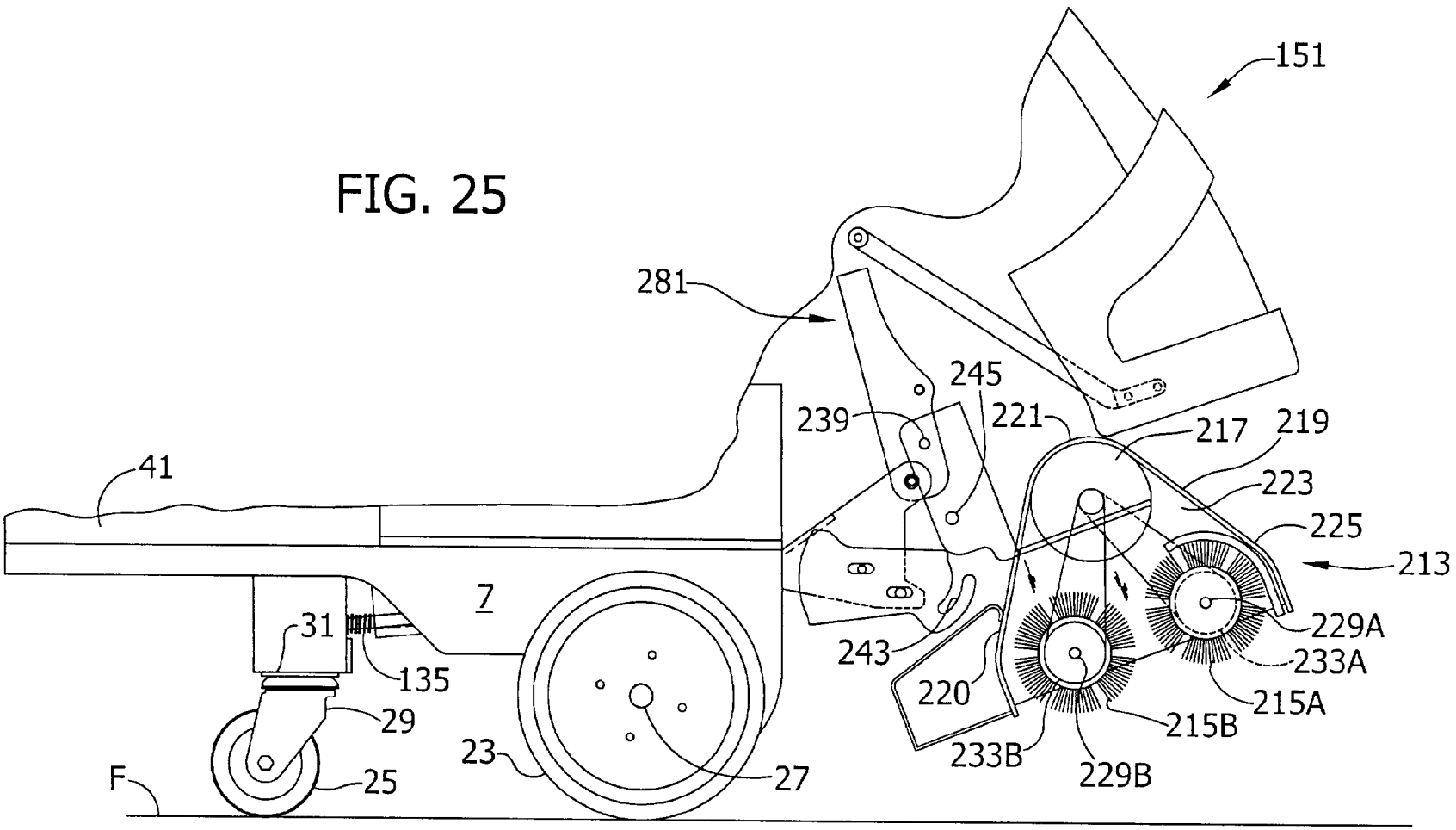
FIG. 25 is a view similar to FIGS. 22, 23 and 24 showing the unit in a servicing position.

Referring back to FIG. 1 as well as to FIG. 21, a housing 55 configured for surrounding at least a substantial portion of the brush motor 17 and brush 15 has a generally circular lower portion 73 which encloses all but rear portion of the brush as shown in FIG. 1 and has a depending bristle skirt 75 for inhibiting solution against being sprayed out from the housing by the rotating brush. An upper portion 74 of the housing 55 surrounds the cradle 52 along with the front and sides of the drive motor 17 and includes laterally opposite side walls 76, 78 (FIG. 21) configured for opposed relationship with the cradle side walls 59, 61 (see FIGS. 5 and 9). The housing 55 of the illustrated embodiment is formed separately from and removably mounted on the cradle 52 for conjoint movement therewith relative to the scrubber 1 and floor surface F. However, it is understood that the housing 55 and cradle 52 may be formed integrally without departing from the scope of this invention.

With particular reference now to FIGS. 6–9, the floor surface treatment unit 13 (the sub-assembly comprising the housing 55, the cradle 52, the brush motor 17 and the brush 15) is carried on the scrubber 1 at its forward (head) end and actuated by means indicated in its entirety at 77 for positioning the unit in the different positions (a), (b) and (c) referred to above. This means 77 includes an actuator, denoted a linear actuator and designated 79 in its entirety, coupled to a link constituted by a lever (broadly, a support for the floor surface treatment unit 13) designated 81 in its entirety, the unit 13 being pivotally suspended (hung) from this lever as will be subsequently described. The lever 81 is generally of U-shape in plan, comprising right and left side arms 83 and 85, respectively, joined by a cross-bar 87 at their forward ends. The left side arm 85 has a downward angled extension 89 at its rear end, this extension having a rearward opening clevis formation 91 at its lower end (see particularly FIGS. 16–20).

Figure 16:
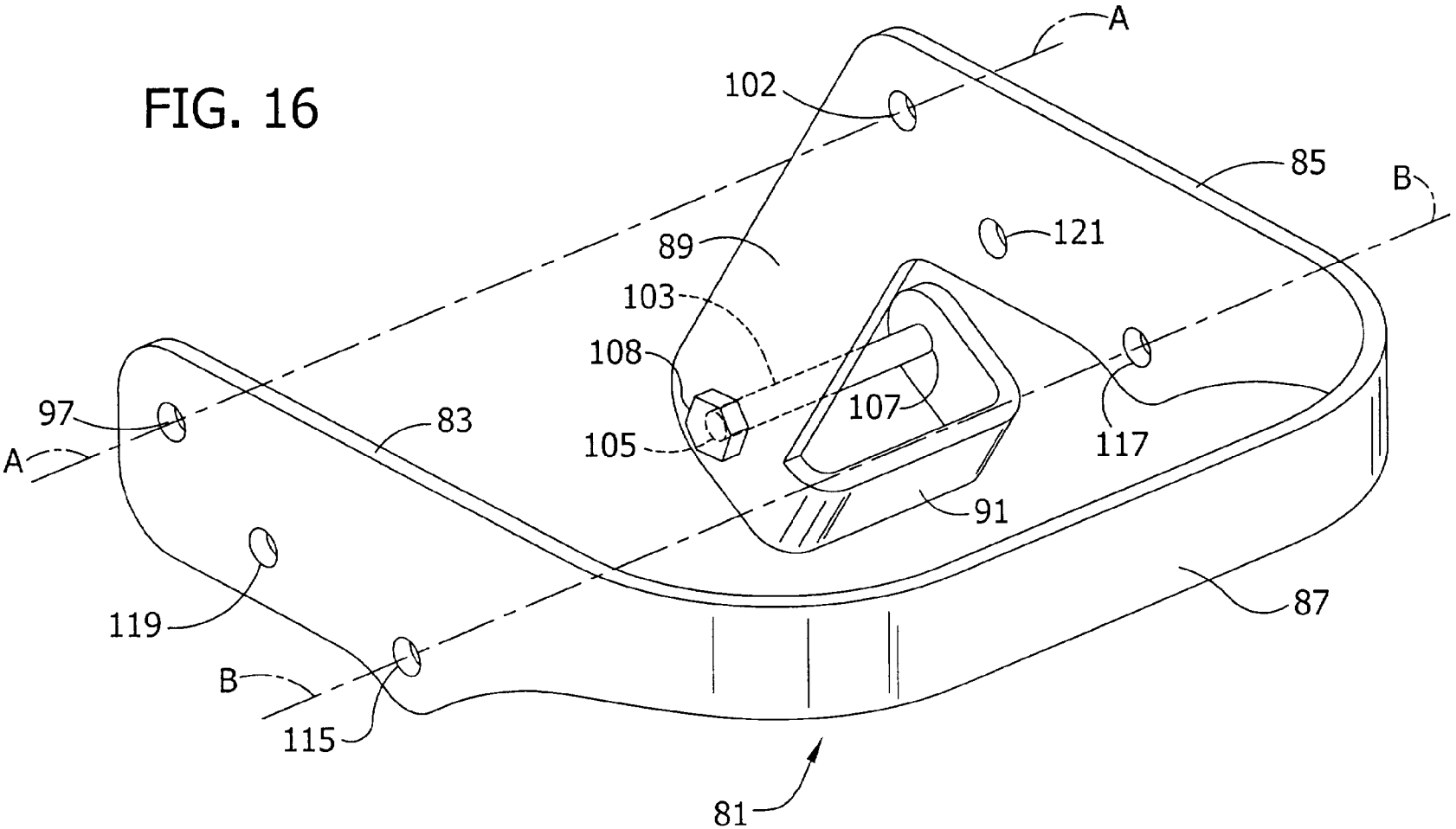
FIG. 16 is a perspective of a support lever per se.
Figure 17:
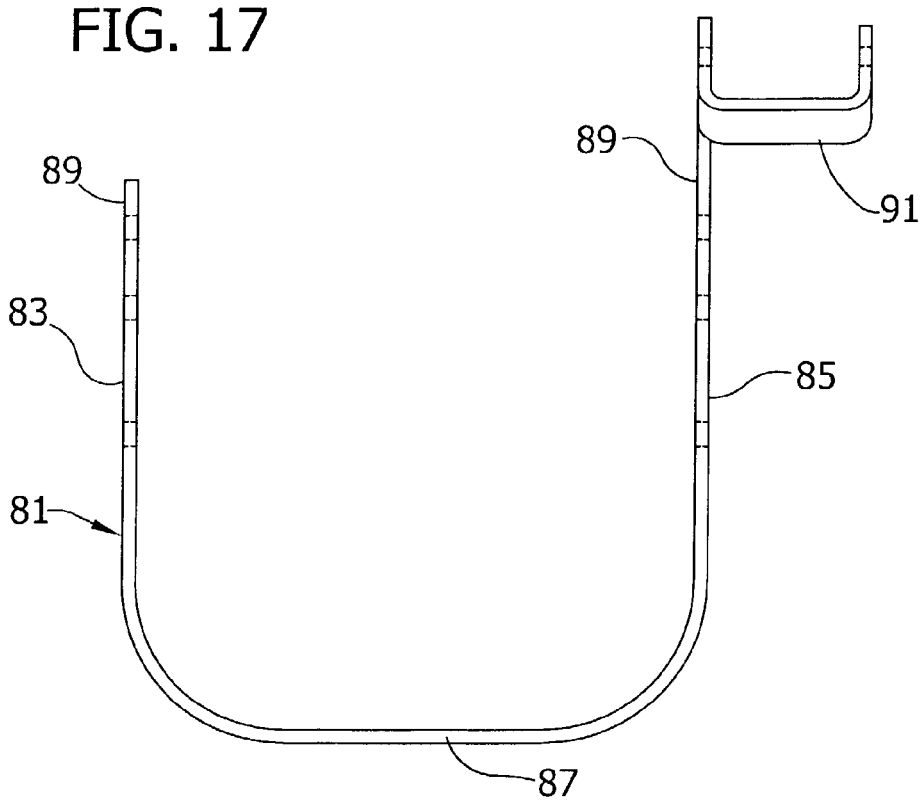
FIG. 17 is a top plan view of FIG. 16 on a smaller scale.
Figure 18:
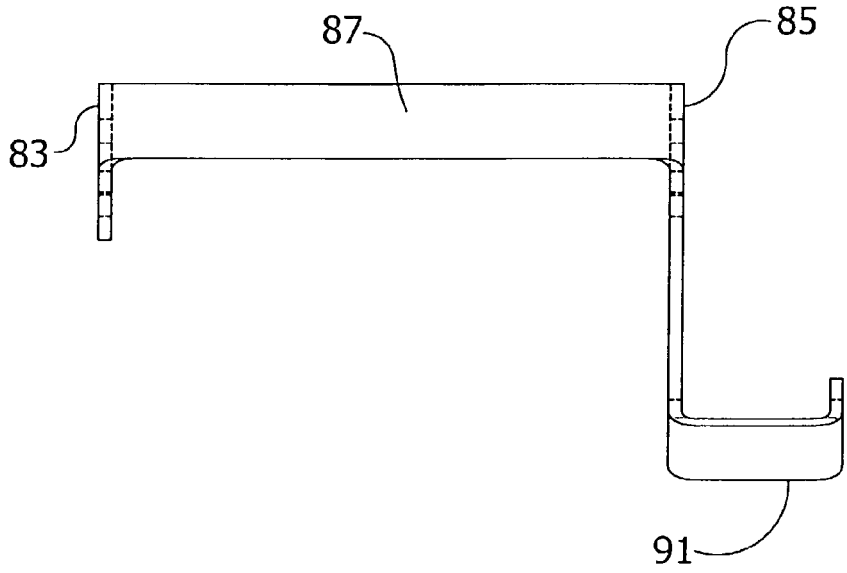
FIG. 18 is an end view of FIG. 17.
Figure 20:
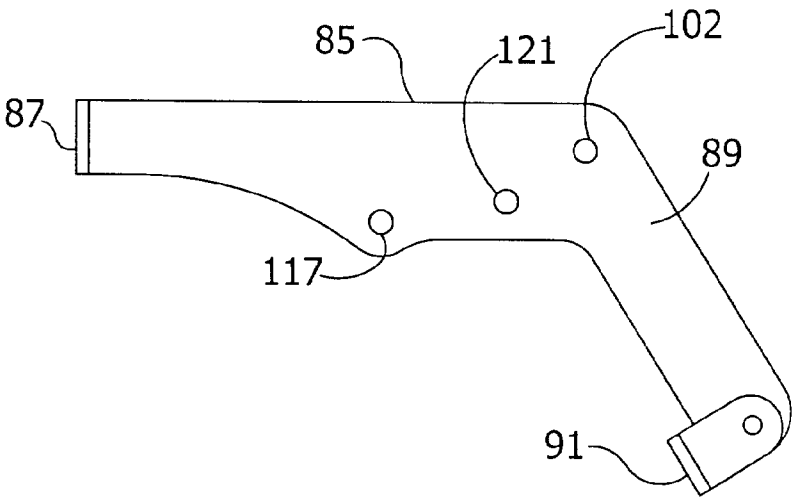
FIGS. 19 and 20 are right and left side views, respectively, of FIG. 18.
Figure 19:
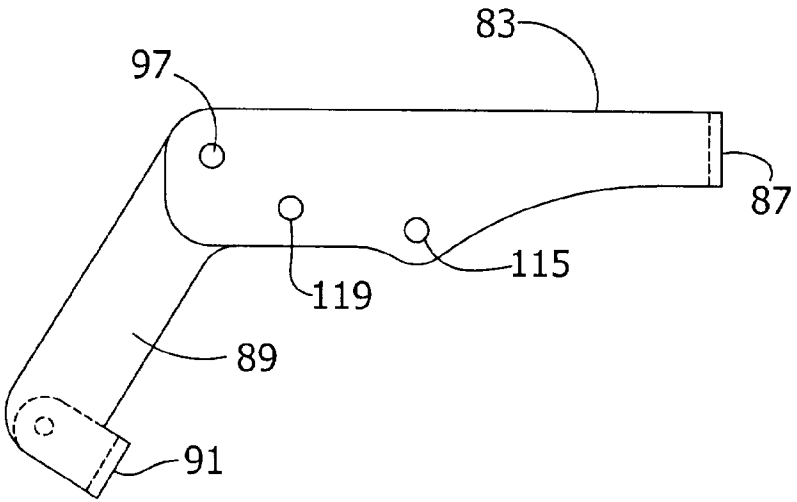

The right side arm 83 is pivotally connected at its rearward end as indicated at 93 to a bracket 95 (see FIGS. 2, 3 and 10–16) extending forward from the forward end of the chassis 7 for swinging movement up and down on a horizontal transverse axis or fulcrum A, arm 83 having a hole 97 (FIG. 16) therein adjacent its rear end for making this connection. The left side arm 85 is pivotally connected as indicated at 99 at the juncture of the arm proper and its extension 89 to a bracket 101 extending forward from the chassis 7 for the swinging of the lever 81 on its fulcrum A. The left side arm 85 has a hole 102 (FIG. 16) opposite hole 97 for making the connection 99. For swinging the lever 81, the linear actuator 79 has a pivotal connection at its forward end with the clevis formation 91 at the lower end of the left side arm extension 89, this connection being made by a bolt 103 (FIGS. 6–9) extending through clevis holes 105, 107 (FIG. 16). The bolt 103 is arranged such that a head 108 (FIG. 16) of the bolt is disposed on the inner side of the clevis formation 91 of the lever 81 for reasons which will become apparent.

The right side arm 83 of the lever 81 is pivotally connected as indicated at 111 with the right side wall 59 of the cradle 52 and the left side arm 85 of the lever is pivotally connected as indicated at 113 with the left side wall 61 of the cradle. These pivotal connections 111, 113 are horizontally transversely aligned, the unit 13 thereby being pivotally carried by the lever 81 for swinging movement about an axis indicated at B in FIGS. 2–9 and 16. The lever arms 83 and 85 have holes 115 and 117 (FIG. 16), respectively, for making the pivotal connections 111, 113. Each arm has a third hole 119 and 121 (FIG. 16), respectively, not used in this embodiment but used in a modified version of the scrubber to be described.

Figure 6:
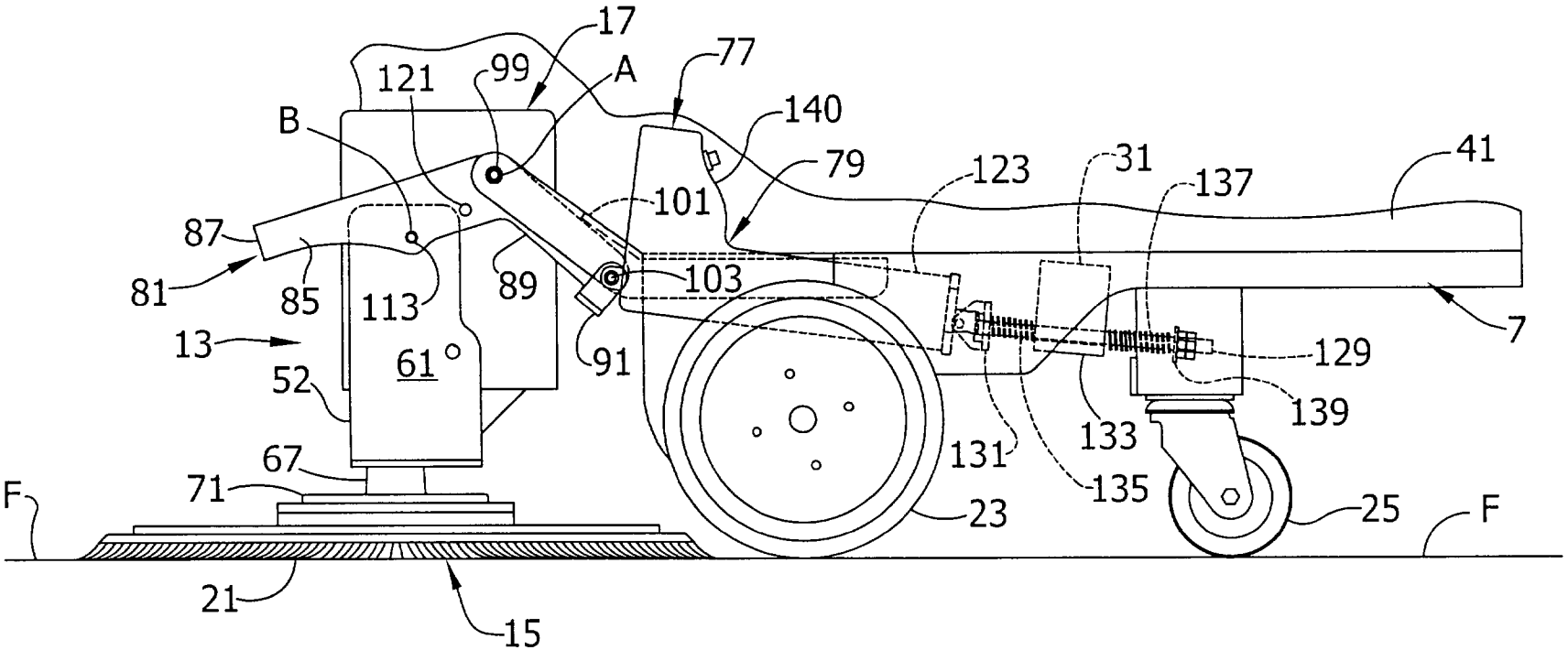
FIGS. 6, 7, 8 and 9 are the left side counterparts of FIGS. 2, 3, 4 and 5 respectively.
Figure 7:
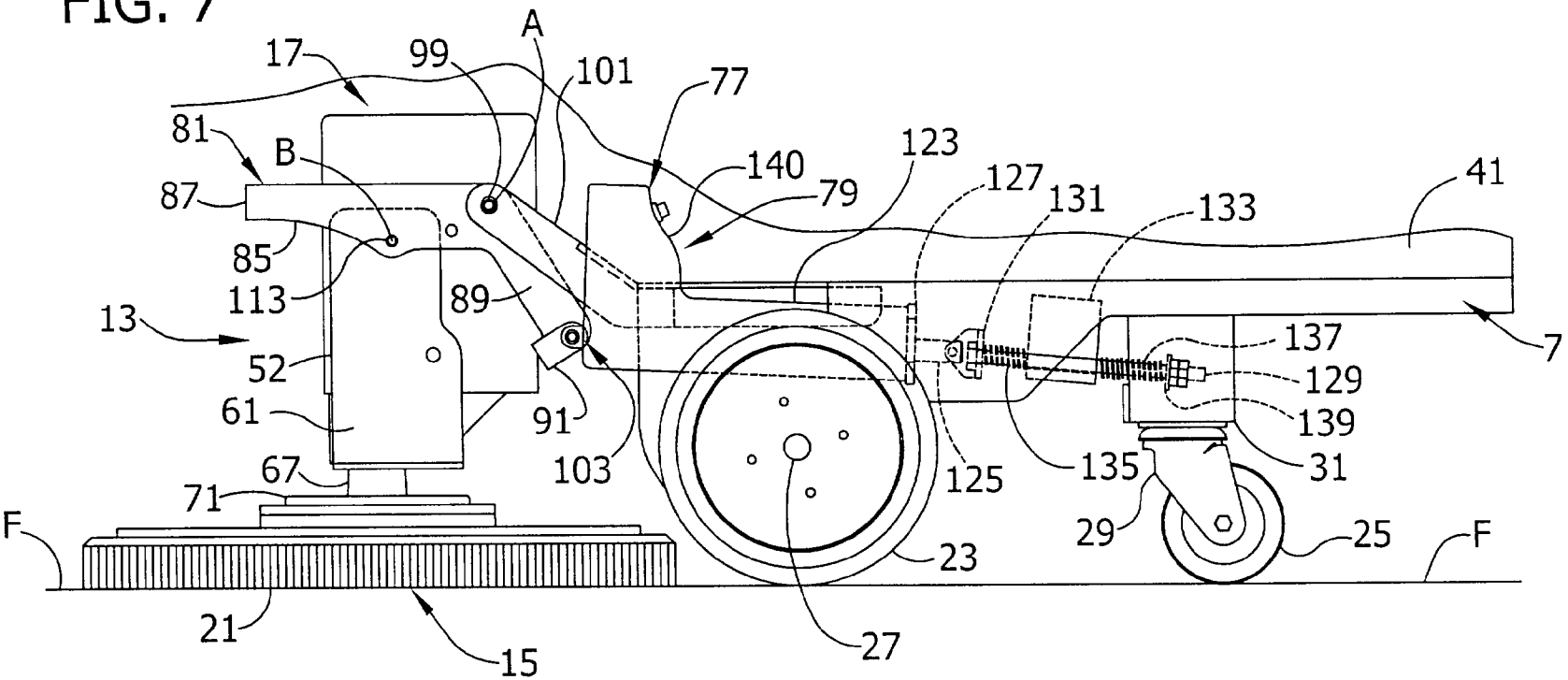
Figure 8:
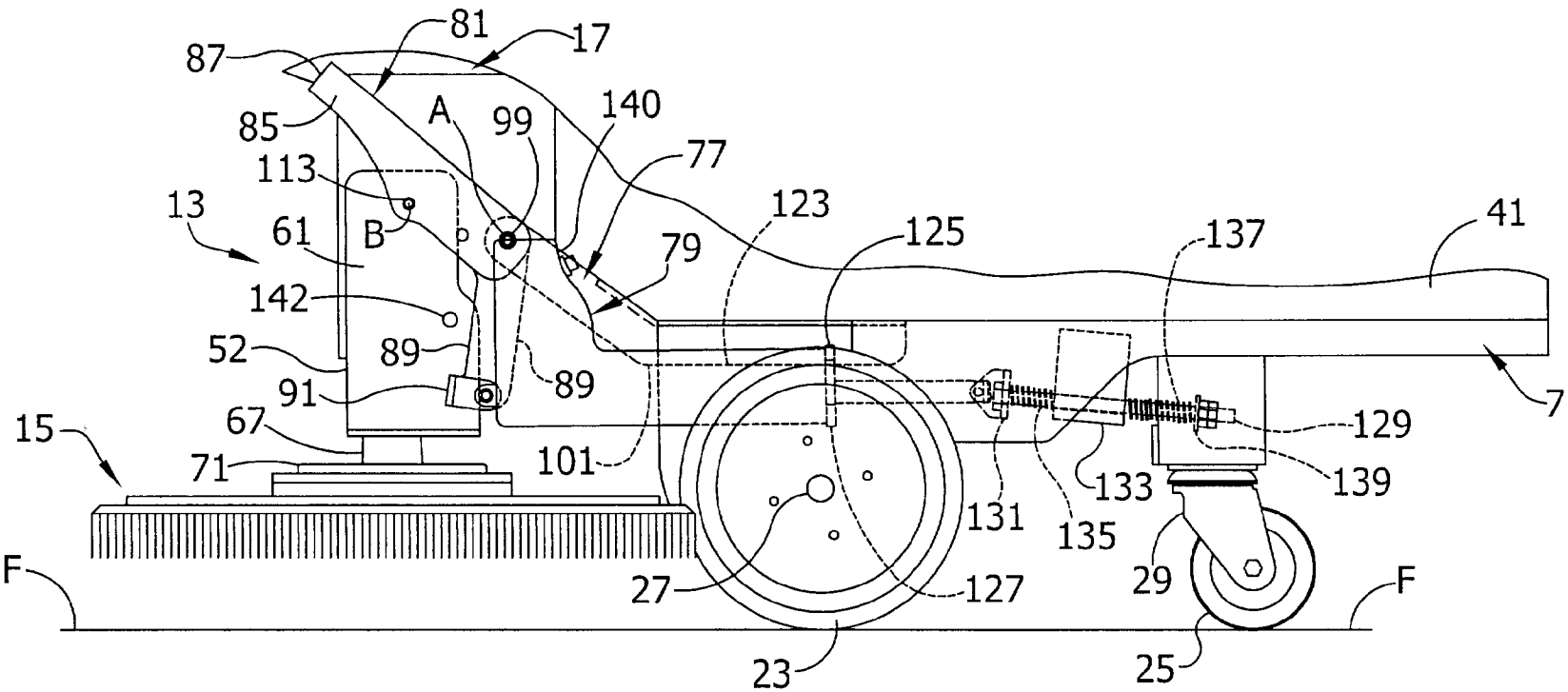
Figure 9:
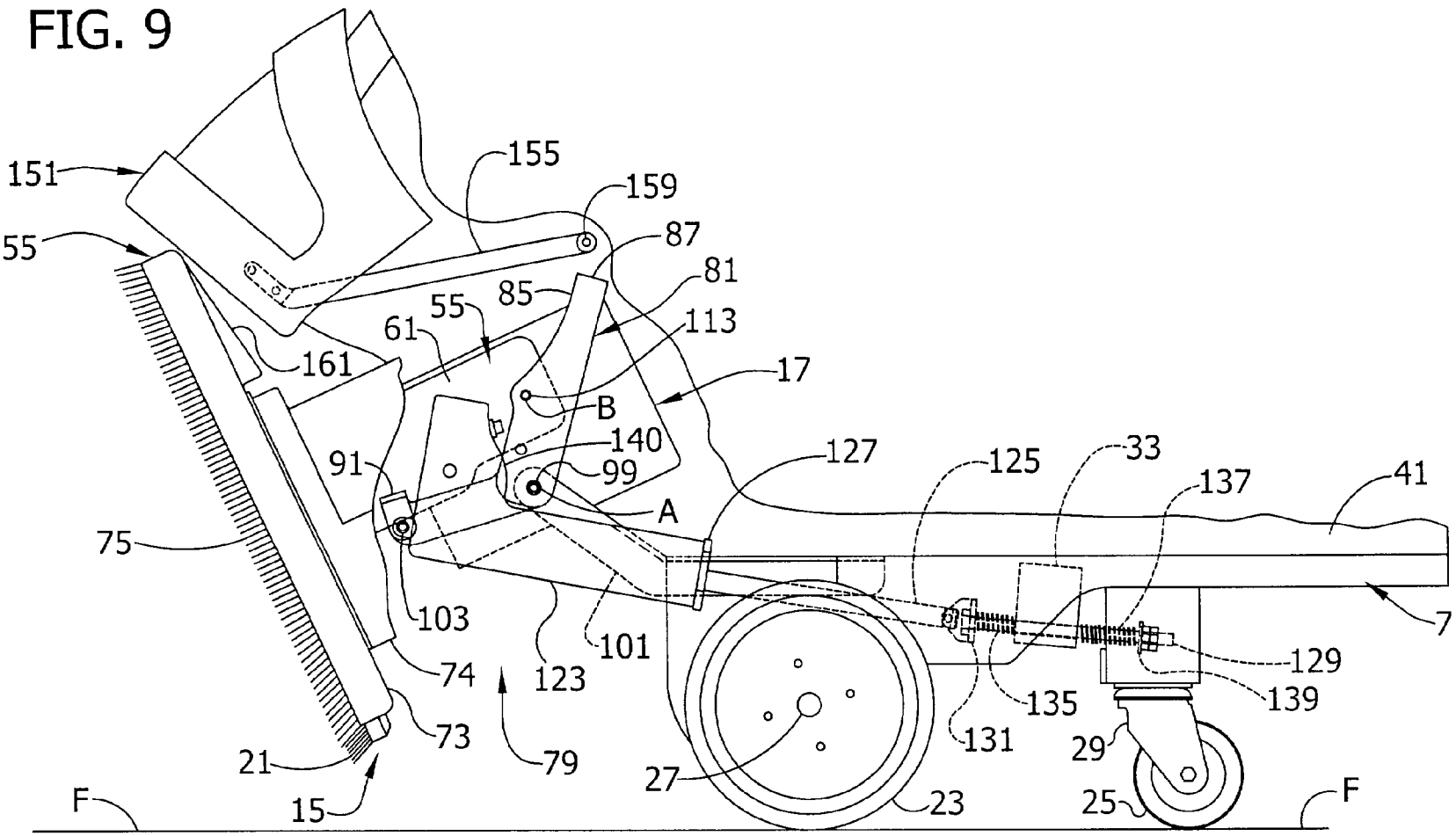
Figure 10:
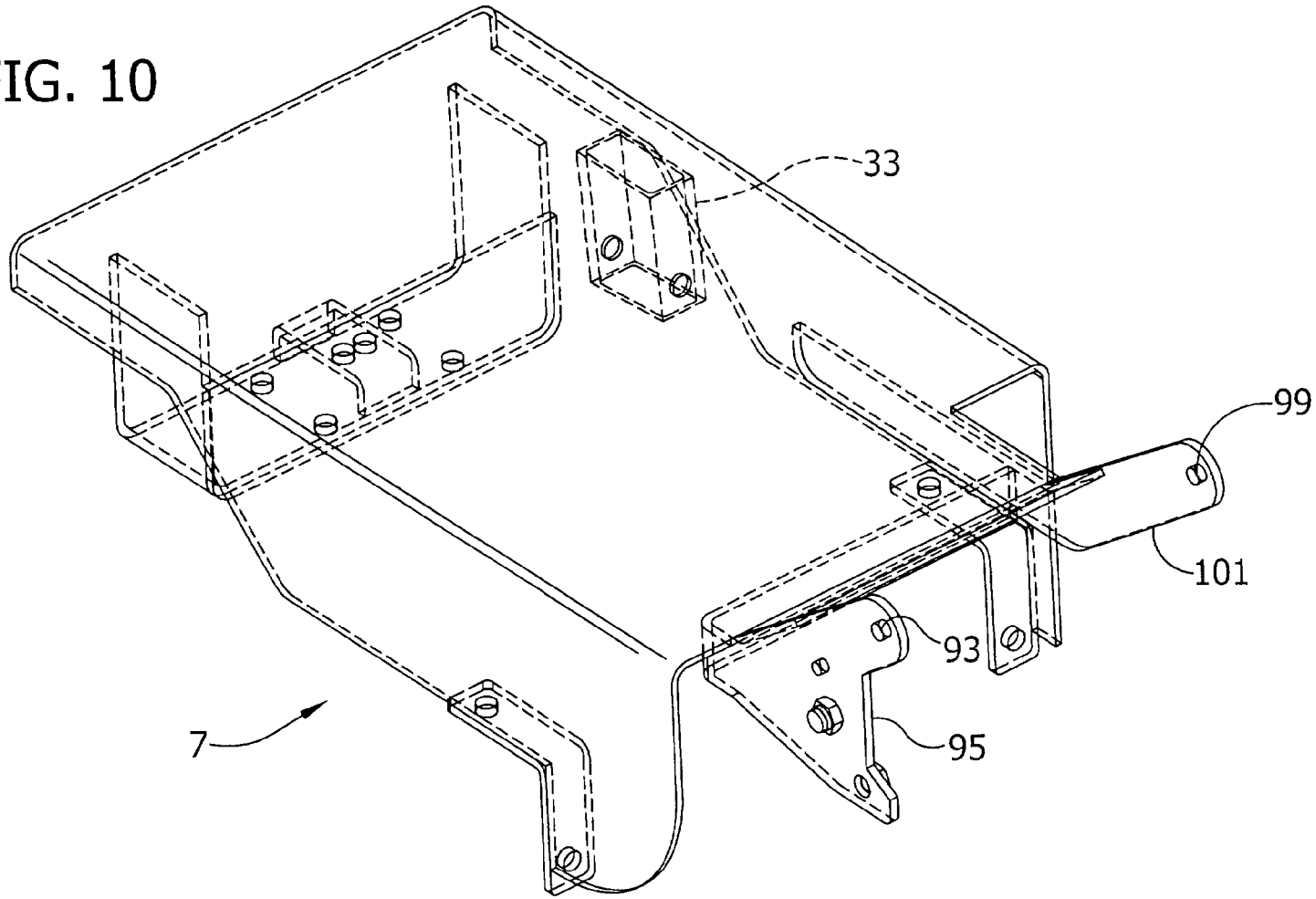
FIG. 10 is a perspective of part of the chassis of the scrubber.
Figure 11:
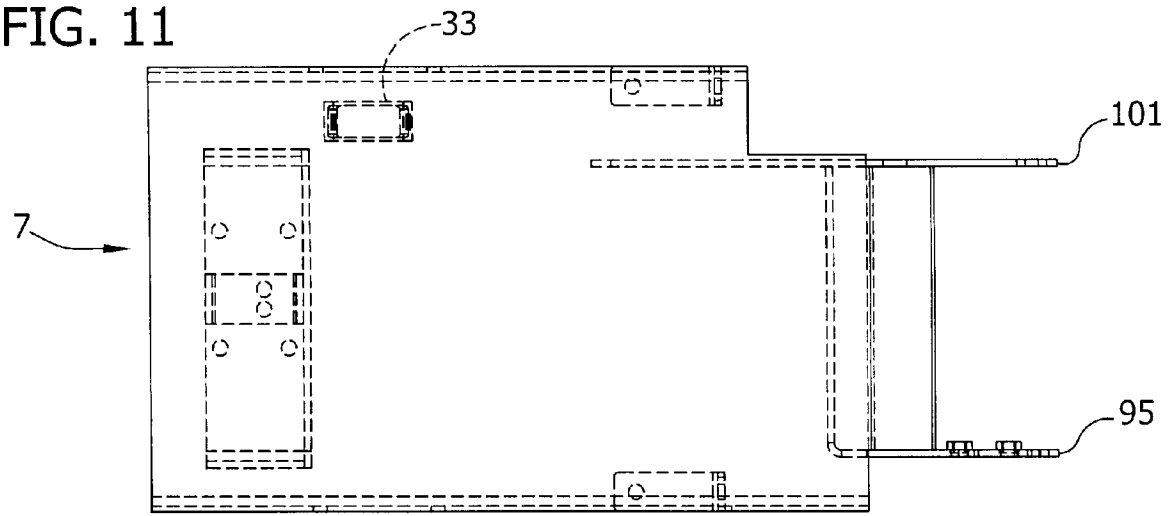
FIG. 11 is a top plan of FIG. 10 on a smaller scale.
Figure 12:
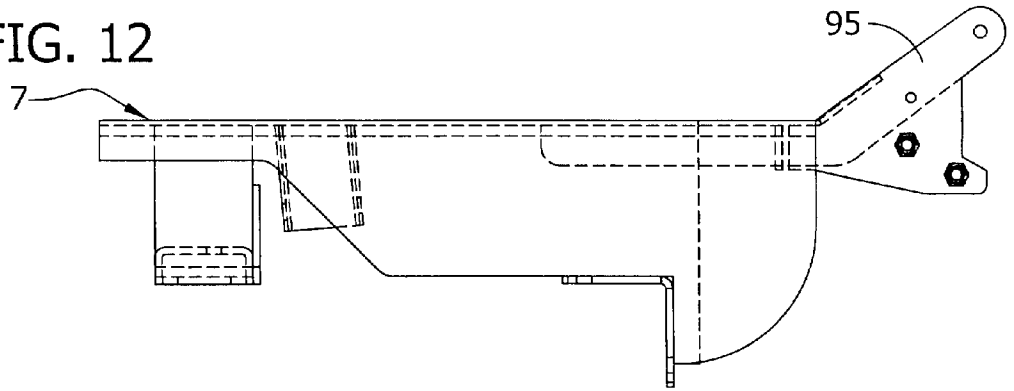
FIG. 12 is a right side elevation of FIG. 11.
Figure 13:
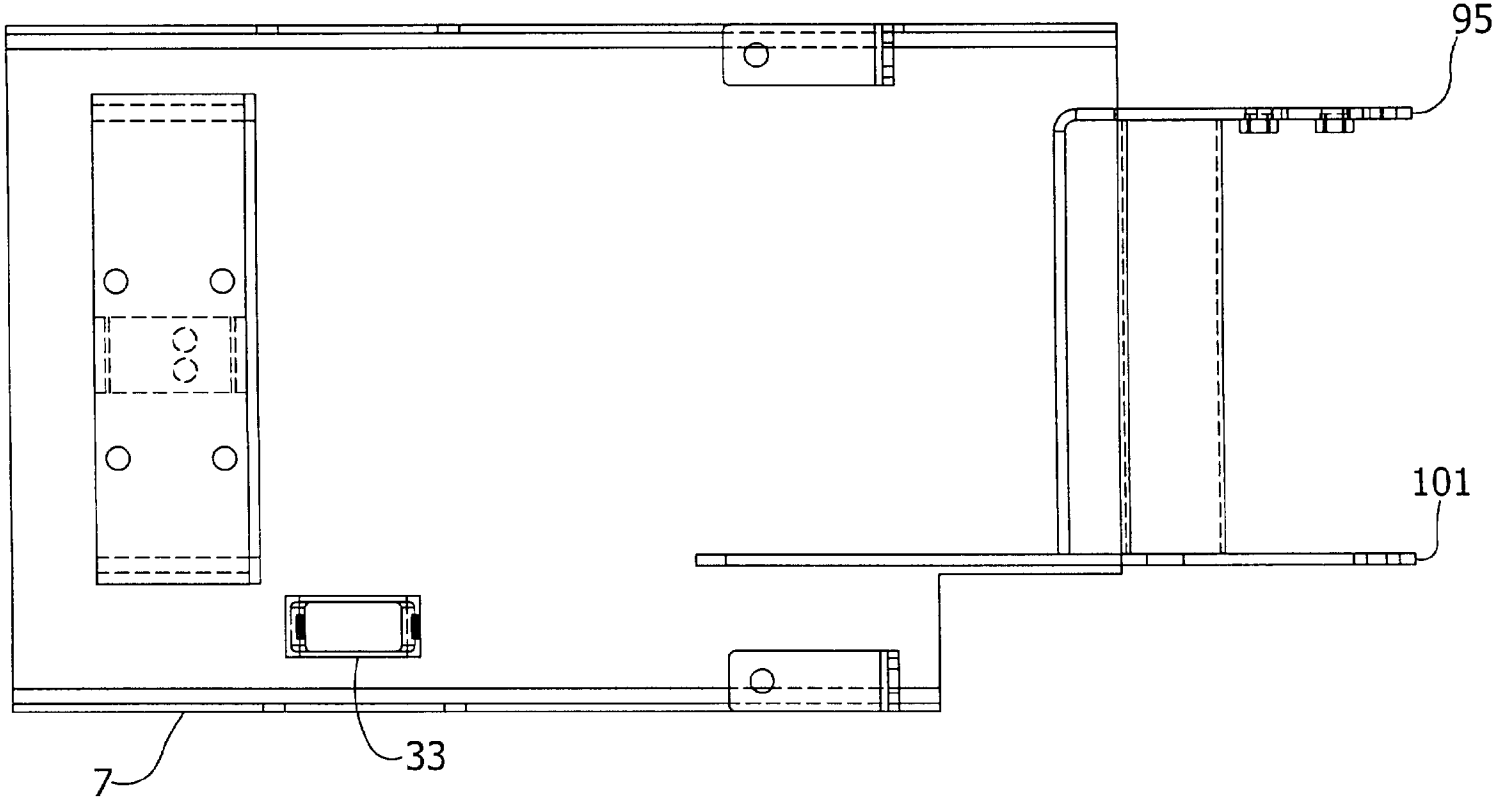
FIG. 13 is a bottom plan of FIGS. 11 and 12.
Figure 15:
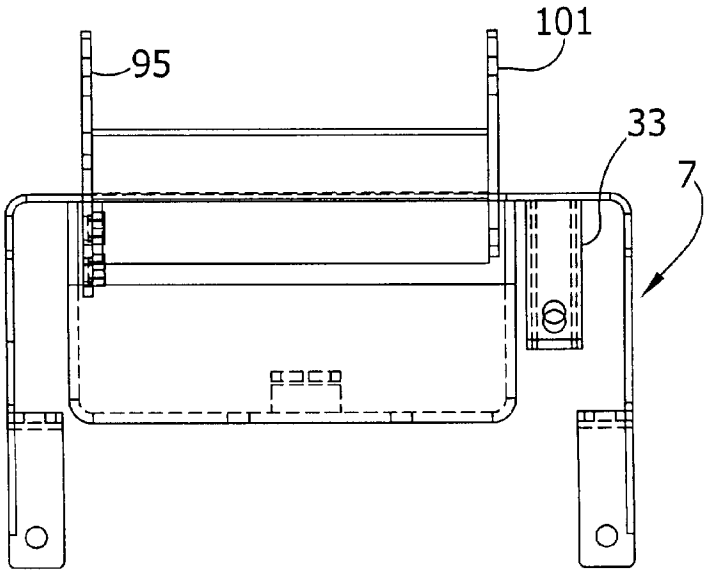
FIGS. 14 and 15 are rear and forward end views, respectively, of FIG. 12.
Figure 14:
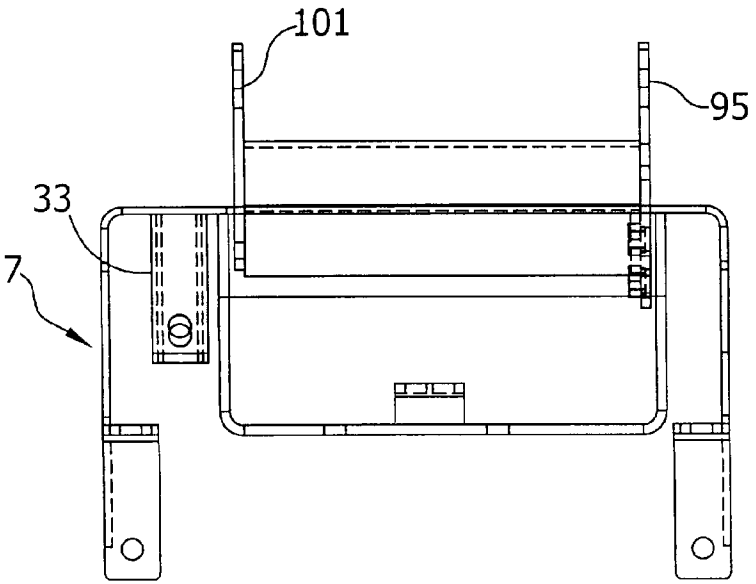

With particular reference back to FIGS. 6–9, the actuator 79 (more precisely the linear actuator 79) is, for example, a commercially available actuator offered under the trade designation Electrak E150 by Warner Electric AB of Kristianstad, Sweden. The actuator 79 generally comprises a tube 123 mounted for reciprocation on its axis lengthwise of the scrubber 1 between a rearward, fully retracted position as shown in FIG. 6 and a forward, fully advanced position corresponding to the servicing position of the unit 13 as shown in FIG. 9. As an example, the actuator tube 123 of the illustrated embodiment is capable of reciprocating approximately 8 inches from its fully retracted position (FIG. 6) to its fully advanced position (FIG. 9). A rod 125 extends axially within the tube 123 through a head 127 disposed at the rear of the tube. A rearward extension 129 of the rod 125, which is coupled to the rearward end of the rod by a pivotable coupling 131, extends rearward through a tubular bushing 133 extending down from and fixed to the chassis 7, the extension 129 being slidable in the bushing. The pivotable coupling 131 permits pivoting movement of the actuator tube 123 and rod 125 relative to the rod extension 129 as the bolt 103 connecting the actuator 79 to the clevis formation 91 of the lever 81 swings up and down with the lever.

A coil compression spring 135 surrounds the rod extension 129 between coupling 131 and the bushing 133 and another coil compression spring 137 surrounds the rod extension 129 between the bushing 133 and a collar 139 on the rearward end of the extension 129. As such, the floor surface treatment unit 13 and actuator 79 (including the actuator tube 123, rod 125 and extension 129) are capable of conjoint forward and rearward sliding movement relative to the chassis 7 and floor surface F against the bias of the compressions springs 135, 137 to reduce the risk of damage to the unit and actuator in the event the unit impacts an object such as a wall or furniture. The collar 139 is selectively movable longitudinally on the extension 129 to adjust the bias of the compression springs 135, 137. For example, in one embodiment, the extension 129 may be threaded at least at its rearward end and the collar 139 may comprise a nut threaded onto the extension. At the forward end of the tube 123 is an actuator housing 140 for housing a suitable drive mechanism (not shown) including an electric motor (not shown) for reciprocating the tube and housing 140. The drive mechanism is in electrical communication with a suitable control 39 on the control panel 37 to permit the operator to selectively position the floor surface treatment unit 13 relative to the floor surface from a location remote from the unit, and more particularly from the rear of the scrubber 1 where the operator is positioned during operation of the scrubber.

A cam plate 141 (FIG. 2), having a forward camming edge 143 engageable by a cam follower 145 extending out from the right side wall 59 of the cradle 52 on the housing 55, is adjustably mounted on the outside of the bracket 95, which extends forward from the chassis 7, for adjustment forward and rearward on the bracket. The mounting comprises bolts 147 extending from the bracket 95 through a pair of slots 149 in the cam plate 141 to enable the adjustment. The formation shown at the rearward end of the cam plate 141 is not used in this embodiment but is instead used in the modified version of the scrubber as will be described.

Figure 5:
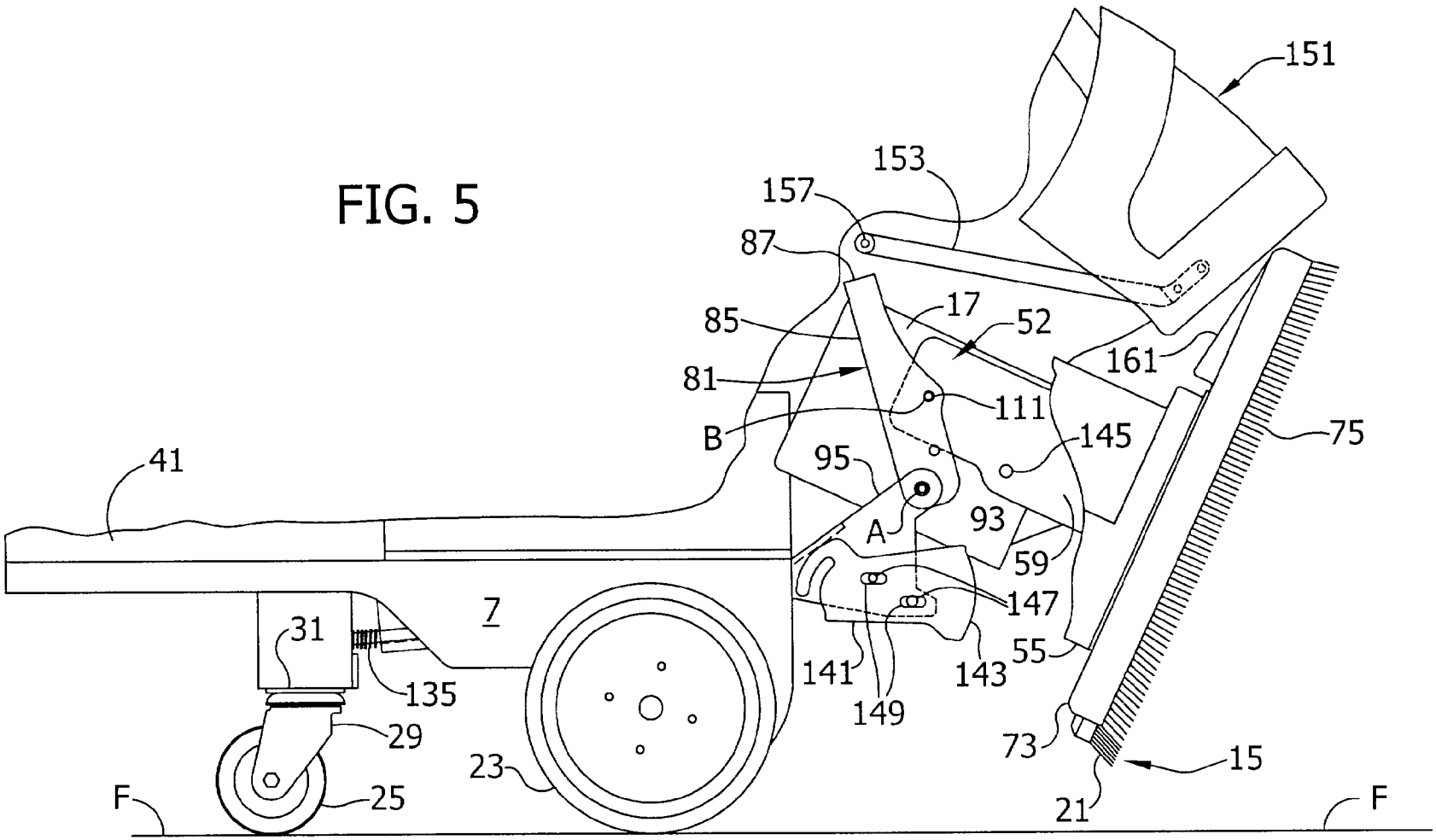
FIG. 5 is a view similar to FIGS. 2, 3 and 4 showing the unit swung up (and forward) to a servicing position and a cover panel of the scrubber in a raised position.

Now referring back to FIG. 1 as well as to FIGS. 5 and 9, the scrubber 1 further comprises a cover panel 151 mounted thereon for swinging movement between a lowered position as shown in FIG. 1 and a raised position as shown in FIGS. 5 and 9. In its lowered position (FIG. 1) the cover panel 151 is positioned in front of an upper portion of the floor surface treatment unit 13 to protect the scrubber 1 including the unit, and particularly the brush motor 17 and housing 55, in the event the forward end of the scrubber should bump into an impediment. In its raised position (FIGS. 5 and 9), the cover panel 151 is swung up above unit 13 in response to the brush 15 being swung up to its servicing position to permit access to unit 13 (especially for changing or otherwise servicing the brush 15). The cover panel 151 is carried by right and left side arms 153 and 155, respectively, pivotably mounted at the rear ends thereof on the scrubber body 5 as indicated at 157 and 159 for swinging movement on a horizontal transverse axis. When the unit 13 is swung up from its transport position (FIGS. 4 and 8) toward its servicing position (FIGS. 5 and 9), a pad 161 mounted on the top of the lower portion 73 of the housing 55 engages the bottom of the cover panel 151 and pushes it up toward its raised position.

In operation, in the working position of the unit 13 the actuator may be reciprocated between its fully retracted position (FIG. 6) wherein the brush 15 is in what is denoted its "full-down" working position (i.e. a fully lowered or maximum down-pressure position) such that the brush bristles 21 engage the floor F under a predetermined pressure and are substantially bent, and a slightly extended position (FIG. 7) in which the brush 15 is raised to a position somewhat above the FIG. 6 position wherein the down-pressure on the brush is substantially reduced; the bristles 21 extending substantially straight down and lightly touching the floor F. These working positions are determined by the actuator 79; full retraction thereof determines the FIGS. 2 and 6 "full-down" working position and limited forward movement thereof determines the FIGS. 3 and 7 working position. As an example, in the illustrated embodiment of FIG. 7, the actuator tube 123 is extended forward approximately 0.75 inches from its fully retracted position (FIG. 6) to swing the lever 81 through a rotation of about 17° to thereby raise the unit 13, and more particularly the brush 15 to the working position shown in FIG. 7.

The actuator tube 123 is desirably capable of reciprocating movement by the actuator 79 in response to a control signal from the control 39 in generally infinitesimal increments between the working positions shown in FIGS. 6 and 7 to permit selective adjustment of the down-pressure on the brush 15. Movement of the brush 15 is effected by axial movement of the tube 123 by the actuator 79 acting to swing the lever 81 relative to the scrubber 1 and floor surface F about the axis A. Because the unit 13 is capable of swinging movement on the lever 81 about axis B, the generally vertical orientation of the unit, and more particularly the orientation of the brush rotation axis X, is maintained as the lever swings about the axis A between the positions shown in FIGS. 6 and 7. The cam follower 145 rides on the camming edge 143 during such movement, the camming edge being profiled to maintain the treatment unit 13 vertical against forces tending to swing it rearward resulting from forward travel of the brush 15 over the floor F and the accompanying friction tending to swing the unit about the axis B.

On further extension of the actuator tube 123 from the position shown in FIG. 7 to the further extended position shown in FIG. 8, the lever 81 is swung up farther to raise the brush 15 some distance (e.g. two inches in the illustrated embodiment) off the floor F to a raised position (denoted the transport position) for transport of the scrubber 1. As an example, in FIG. 8, the actuator tube 123 has been extended approximately 3.5 inches from its fully retracted position (FIG. 6) to swing the lever 81 about the axis A through a rotation of about 62° from the position shown in FIG. 6. The unit 13 is still capable of swinging movement on the lever 81 about axis B as the unit is raised to its transport position such that the generally vertical orientation of the unit, and more particularly the orientation of the brush rotation axis X, is maintained as the lever swings about the axis A to the position shown in FIG. 8. The cam follower 145 also remains in engagement with the camming edge 143 of the cam plate 141. As can be seen by comparing FIG. 8 to FIG. 6, the actuator tube 123, housing 140 and rod 125 are pivoted about the coupling 131 as the lever 81 swings about the axis A. For example, the actuator tube 123 is pivoted through a downward (e.g., counter-clockwise in FIGS. 6 and 8) rotation of about 4–5° as the actuator tube extends from the fully retracted position of FIG. 6 to the position shown in FIG. 8 corresponding to the transport position of the floor surface treatment unit 13.

Upon forward extension of the actuator tube 123 beyond the FIG. 8 position, the lever 81 is swung up to the position shown in FIGS. 5 and 9 corresponding to the servicing position of the floor surface treatment unit 13. More particularly, as the lever 81 swings up beyond the position shown in FIG. 8, the head of the bolt 103 which connects the actuator 79 to the clevis formation 91 of the lever 81 engages the left side wall 61 of the cradle 52 to inhibit swinging movement of the floor surface treatment unit 13 (e.g., the housing 55, cradle, brush motor 17 and brush 15) about axis B and to thereby lift the unit to its servicing position as shown in FIGS. 5 and 9. As an example, the actuator is extended approximately eight inches in FIG. 9 to thereby swing the lever about axis A through a rotation of about 127° relative to the position shown in FIG. 6. As a result, the brush 15 is inclined at an angle of about 65° relative to horizontal, with the bristles 21 extending generally forward. However, it is understood that the angle of inclination of the brush 15 may vary without departing from the scope of this invention. Also, the actuator tube 123, housing 140 and rod 125 have been pivoted on the coupling 133 generally up (e.g., clockwise) approximately 8° in the servicing position of FIG. 9.

From the above, it will be observed that the floor surface treatment apparatus of the invention comprises the wheeled vehicle 3 having a rearward end 11 (e.g., the operator's end in the illustrated embodiment) and a forward end 9, a support (e.g., lever 81) at the forward end for a floor surface treatment unit, a floor surface treatment unit 13 pivotally carried by the support 81 for swinging movement about an axis B transverse to the vehicle, the support being movable to raise and lower the unit through a range of positions in which the unit maintains a generally vertical orientation hanging down from the support and to swing the unit up to a position for servicing.

FIGS. 22–25 illustrate a modification of the scrubber 1 of this invention, designated 201 to distinguish it from scrubber 1, wherein the floor surface treatment unit is designated 213 to distinguish it from unit 13 and comprises two cylindrical brushes each having each having a rotation axis extending horizontally transverse to the unit 213 and rotary on said axes. A first of the brushes, designated 215A, constitutes a forward brush and the second brush, designated 215B, is disposed immediately rearward of and parallel to the first brush. The brushes 215A, 215B are journalled in a brush housing, generally designated 255, which is of generally triangular form having front and rear walls respectively designated 219 and 220 tapering up toward a rounded apex 221, and end walls (one of which is shown in FIGS. 22–25 and designated 223. The housing is open at its bottom for protrusion of the brushes 215A, 215B.

The brushes 215A, 215B are on axial shafts 229A and 229B journalled at their ends in the end walls 223. A brush motor 217 housed in the housing 255 adjacent its apex 221 is adapted to drive the brushes 215A, 215B via chain and sprocket drives 233A and 233B. The housing 255, is mounted on a bracket 237 which is pivotally mounted as indicated at 239 using holes 117, 119 on lever 81, the unit 213 thereby being in effect pivotally mounted at 239 on the lever 81 (e.g., in the same manner that unit 13 is pivotally mounted on the lever in FIGS. 1–9). The orientation of the cam plate 141 mounted on bracket has been rotated 180° such that a curved cam slot 243 in which the cam follower 245 extending out from a right side wall 259 of the bracket 237 is engageable for the same purpose as cam follower 145 is engageable with camming edge 143. Otherwise, the scrubber 201 generally duplicates the scrubber 1 in structure and operation, including actuator 79 operably coupled to lever 81 to move the brush unit 213 between a working position (FIGS. 22 and 23) in which the brushes 215A, 215 are down against the floor F, a transport position (FIG. 24) in which the brushes are raised up off the floor, such as about 1.5 inches for transport of the scrubber and a servicing position in which the brush unit 13 is swung up to a position in which the brushes in part face forward for servicing of the brushes. For example, in the illustrated embodiment the brushes are angled approximately 45° relative to horizontal.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A floor surface treatment apparatus comprising:

a wheeled vehicle for travel over a floor surface, said vehicle having a support for a floor surface treatment unit said support having a central juncture and a rearward end, the support being pivotally connected to said wheeled vehicle at said central juncture of said support for pivotal movement relative to said vehicle;

a floor surface treatment unit pivotally carried by the support by pivotally suspending from a pivotal connection for swinging movement relative thereto about a horizontal axis substantially parallel to the floor surface defined by said pivotal connection;

an actuator operably attached to said support at said rearward end for effecting rotatable movement of the support relative to said wheeled vehicle; and said support being configured to raise and lower said unit relative to the floor surface, upon pivotal movement of the support relative to said vehicle, through a range of working positions in which the unit maintains a generally vertical orientation relative to the floor surface and is generally in contact therewith and further to a servicing position in which the floor surface treatment unit is swung up and forward relative to said vehicle about said horizontal axis above the floor surface to a position in which the floor surface treatment unit is generally angled relative to the floor surface due to urging of the rearward end by the actuator against the unit.

2. A floor surface treatment apparatus as set forth in claim 1 wherein the support is pivotally mounted on the vehicle for swinging movement relative thereto, said unit being carried by the support such that swinging movement of said support is effective to raise or lower the floor surface treatment unit relative to said vehicle, and where the floor surface treatment unit further comprises a cam follower whereby the unit maintains a generally vertical orientation relative to the floor surface as the cam follower follows along a cam mounted to the wheeled vehicle.

3. A floor surface treatment apparatus as set forth in claim 2 wherein the support is configured to inhibit swinging movement of the floor surface treatment unit relative to said support when said unit is raised above the floor surface by said support whereby the floor surface treatment unit swings conjointly with the support relative to the vehicle to swing said unit up to its servicing position.

4. A floor surface treatment apparatus as set forth in claim 1 wherein said support is configured to position said unit in a transport position intermediate said range of working positions and said servicing position for transport of said apparatus, in the transport position said unit being raised up off of the floor surface and in a generally vertical orientation relative to said floor surface.

5. A floor surface treatment apparatus as set forth in claim 1 wherein the floor surface treatment unit is pivotally carried by the support for swinging movement relative to the vehicle about an axis transverse to the vehicle.

6. A floor surface treatment apparatus as set forth in claim 1 wherein said floor surface treatment unit comprises a motor and at lease one rotary treatment component operatively driven by said motor.

7. A floor surface treatment apparatus as set forth in claim 6 wherein said at least one rotary treatment component comprises a rotary scrub brush.

8. A floor surface treatment apparatus as set forth in claim 7 wherein the brush is a disk-type brush rotary on a generally vertical axis.

9. A floor surface treatment apparatus as set forth in claim 6 wherein said at least one rotary treatment component comprises a generally cylindrical brush rotary generally on a longitudinal axis of the brush, said axis extending generally horizontally and transversely with respect to the vehicle.

10. A floor surface treatment apparatus as set forth in claim 9 wherein said cylindrical brush is a first cylindrical brush, said at least one treatment component further comprising a second cylindrical brush rotary on an axis generally parallel to the axis on which the first cylindrical brush rotates.

11. A floor surface treatment apparatus as set forth in claim 1 wherein said support comprises a lever pivotally mounted on the vehicle for swinging movement relative to said vehicle, said apparatus further comprising an actuator pivotally coupled to said lever for driving swinging movement of the lever relative to the vehicle.

12. A floor surface treatment apparatus as set forth in claim 11 wherein said actuator is a linear actuator and has a driving mechanism for moving the actuator generally linearly relative to said vehicle to swing said lever.

13. A floor surface treatment apparatus as set forth in claim 11 wherein the actuator is mounted on the vehicle for sliding movement relative thereto.

14. A floor surface treatment apparatus as set forth in claim 13 wherein the vehicle has a longitudinal axis, the actuator being mounted on the vehicle for sliding movement relative thereto at least in part parallel to the longitudinal axis of said vehicle.

15. A floor surface treatment apparatus as set forth in claim 13 further comprising at least one biasing member adapted to bias the actuator against sliding movement relative to said vehicle.

16. A floor surface treatment apparatus as set forth in claim 13 wherein said at least one biasing member comprises at least one coil compression spring.

17. A floor surface treatment apparatus as set forth in claim 2, wherein said cam is a cam plate having a camming edge engageable by said cam follower on the floor surface treatment unit as said unit is raised and lowered through said range of working positions.

18. A floor surface treatment apparatus as set forth in claim 1 having a cover panel carried by the vehicle for movement from a lowered position generally covering at least a portion of said unit to a raised position for accessing the unit in the servicing position.

19. A floor surface treatment apparatus as set forth in claim 18 wherein the cover panel is engageable by the floor surface treatment unit upon movement of said unit toward its servicing position to raise the cover panel to its raised position.

20. A floor surface treatment apparatus as set forth in claim 1 wherein the floor surface treatment apparatus is further adapted with a controller operable to selectively raise and lower the floor surface treatment unit by electrical communication from a location remote from said unit.

21. A floor surface treatment apparatus as set forth in claim 20 further comprising a control panel on said apparatus remote from the floor surface treatment unit and a control on the control panel operatively connected to the floor surface treatment unit for controlling the raising and lowering of the floor surface treatment unit relative to the floor surface.

22. A floor surface treatment apparatus comprising:

a wheeled vehicle for travel over a floor surface, said vehicle having a support for a floor surface treatment unit said support having a central juncture and a rearward end, the support being pivotally connected to said wheeled vehicle at said central juncture of said support for pivotal movement relative to said vehicle;

a floor surface treatment unit pivotally carried by the support by pivotally suspending from a pivotal connection for swinging movement relative thereto about a horizontal axis substantially parallel to the floor surface defined by said pivotal connection; and said support being configured to raise and lower said unit relative to the floor surface, upon pivotal movement of the support relative to said vehicle, through a range of working positions in which the unit maintains a generally vertical orientation relative to the floor surface and is generally in contact therewith and further to a servicing position in which the floor surface treatment unit is swung up and forward relative to said vehicle about said horizontal axis above the floor surface to a position in which the floor surface treatment unit is generally angled relative to the floor surface due to urging of the rearward end by the actuator against the unit.

23. A floor surface treatment apparatus as set forth in claim 22 wherein the vehicle has a longitudinal axis, the actuator being mounted on the vehicle for sliding movement relative thereto at least in part parallel to the longitudinal axis of said vehicle.

24. A floor surface treatment apparatus as set forth in claim 22 further comprising at least one biasing member adapted to bias the actuator against sliding movement relative to said vehicle.

25. A floor surface treatment apparatus as set forth in claim 24 wherein said at least one biasing member comprises at least one coil compression spring.

* * * * *